US012745870B1

(12) United States Patent
Radoff

(10) Patent No.: US 12,745,870 B1
(45) Date of Patent: Sep. 29, 2026

(54) DRINK HOLDER INSERT SYSTEM AND METHOD OF USE

(71) Applicant: Daniel Scott Radoff, Dallas, TX (US)

(72) Inventor: Daniel Scott Radoff, Dallas, TX (US)

( * ) Notice: Subject to any disclaimer, the term of this patent is extended or adjusted under 35 U.S.C. 154(b) by 0 days.

(21) Appl. No.: 19/332,685

(22) Filed: Sep. 18, 2025

Related U.S. Application Data

(63) Continuation-in-part of application No. 19/237,810, filed on Jun. 13, 2025, which is a continuation of application No. 18/967,308, filed on Dec. 3, 2024, now abandoned, which is a continuation-in-part of application No. 18/905,426, filed on Oct. 3, 2024, now abandoned.

(60) Provisional application No. 63/624,161, filed on Jan. 23, 2024, provisional application No. 63/837,528, filed on Jul. 2, 2025.

(51) Int. Cl.
*B65D 83/00* (2006.01)
*A47G 19/12* (2006.01)
*A47G 19/22* (2006.01)

(52) U.S. Cl.
CPC ..... *A47G 19/2205* (2013.01); *A47G 19/12* (2013.01); *A47G 2019/122* (2013.01)

(58) Field of Classification Search
CPC ..... A47G 19/2205; A47G 19/12; A47G 2019/122
See application file for complete search history.

(56) References Cited

U.S. PATENT DOCUMENTS 225,143 A * 3/1880 Kahler ..... A47G 19/24 220/253
830,001 A * 9/1906 Robert ..... B65D 1/04 215/6
2,241,044 A * 5/1941 Knut ..... B65D 47/265 220/253
2,655,288 A * 10/1953 Caretto ..... A47G 19/24 222/548
3,130,874 A * 4/1964 Bulmer ..... A47G 19/34 222/443
3,831,743 A * 8/1974 Leedy ..... B65D 83/02 206/338
4,288,006 A * 9/1981 Clover, Jr. ..... B65D 47/265 222/42
8,328,044 B1 * 12/2012 Iskandar ..... A47G 19/2272 220/254.3
2006/0137533 A1 * 6/2006 Wise ..... A47J 31/06 99/279
2012/0187066 A1 * 7/2012 Redl ..... A47J 41/0038 215/11.2
2013/0001233 A1 * 1/2013 Hylton ..... A47G 19/2272 220/592.2

(Continued)

*Primary Examiner* — Bob Zadeh
(74) *Attorney, Agent, or Firm* — Richard Eldredge; Leavitt Eldredge Law Firm

(57) ABSTRACT

A cup system includes a cup having an inner area; a housing configured to fit within the inner area of the cup, the housing includes a first fluid cavity; a second fluid cavity; and a divider that separates the first fluid cavity from the second fluid cavity. The system includes a lid stop that rests on the divider, the lid stop having a lid opening that is in fluid communication with either the first fluid cavity or the second fluid cavity. The system includes a lid that rests on both the lid stop and the cup, the lid rotates relative to the lid stop and has a lid opening in fluid communication with the lid stop opening.

1 Claim, 7 Drawing Sheets

(56) References Cited

U.S. PATENT DOCUMENTS

| | | | | |
|---|---|---|---|---|
| 2013/0026185 | A1* | 1/2013 | Horvath | B65D 85/72 222/144.5 |
| 2015/0136767 | A1* | 5/2015 | Chen | A47G 19/2205 220/23.2 |
| 2018/0134451 | A1* | 5/2018 | Chen | B65D 25/04 |
| 2019/0231102 | A1* | 8/2019 | Dahab | A47J 41/024 |

* cited by examiner

DRINK HOLDER INSERT SYSTEM AND METHOD OF USE

BACKGROUND

1. Field of the Invention

The present invention relates generally to drink holder systems and methods of use.

2. Description of Related Art

Conventional drink holders are well known in the art and are effective means to keep a beverage hot or cold. However, the drink holder is not adapted to keep two different beverages in the same holder and not adapted to keep one of the two beverages cold while the other remains hot.

Accordingly, although great strides have been made in the area of drink holders, many shortcomings remain.

DESCRIPTION OF THE DRAWINGS

The appended claims set forth the novel features believed characteristic of the embodiments of the present application. However, the embodiments themselves, as well as a preferred mode of use, and further objectives and advantages thereof, will best be understood by reference to the following detailed description when read in conjunction with the accompanying drawings, wherein:

Figure 1:
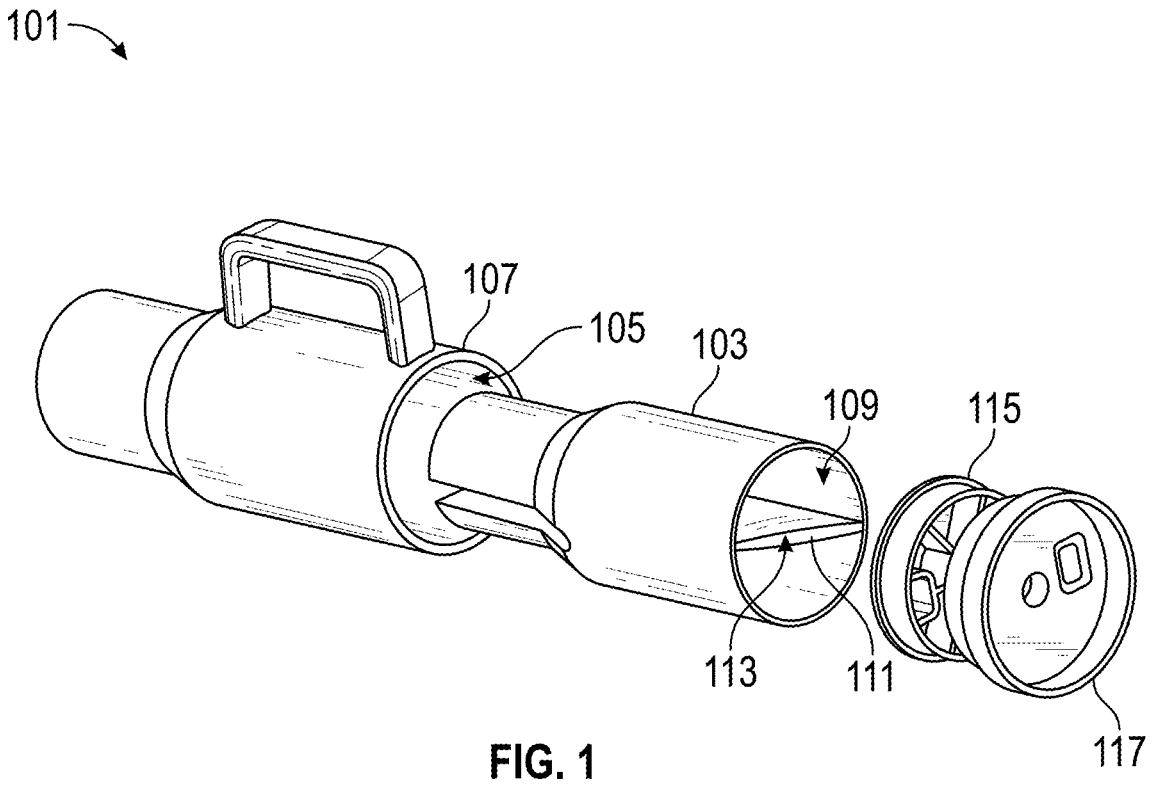
FIG. 1 is an oblique view of the system of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the device are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments are expressly contemplated herein so that one of ordinary skill in the art would appreciate from this disclosure that the features, elements, and/or functions of one embodiment may be incorporated into another embodiment as appropriate unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-13 depict various views of the system and method of use in accordance with one preferred embodiment of the present application.

FIG. 1 illustrates a cup system 101 in accordance with a preferred embodiment of the present invention and includes a cup 107 that forms an opening 105 for a housing 103 to fit therein. The housing 103 has a body that forms an opening 109 that is separated by a divider 111 with a top surface 113. A lid stop 115 first withing the opening 109 and rest on top surface 113. A lid 117 rotatably engages with the lid stop 115.

Figure 2:
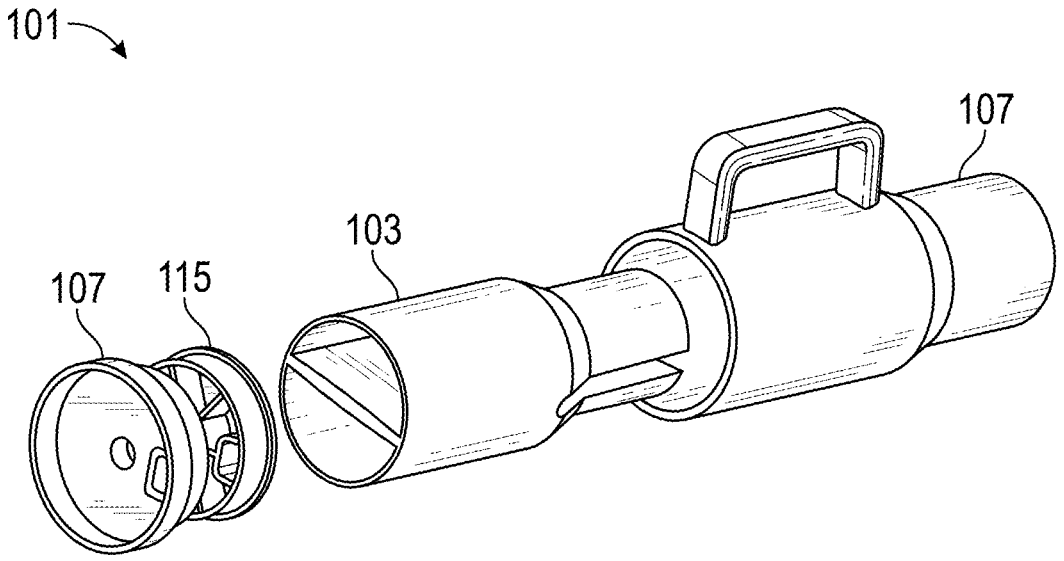
FIG. 2 is an oblique view of the system of FIG. 1.
Figure 3:
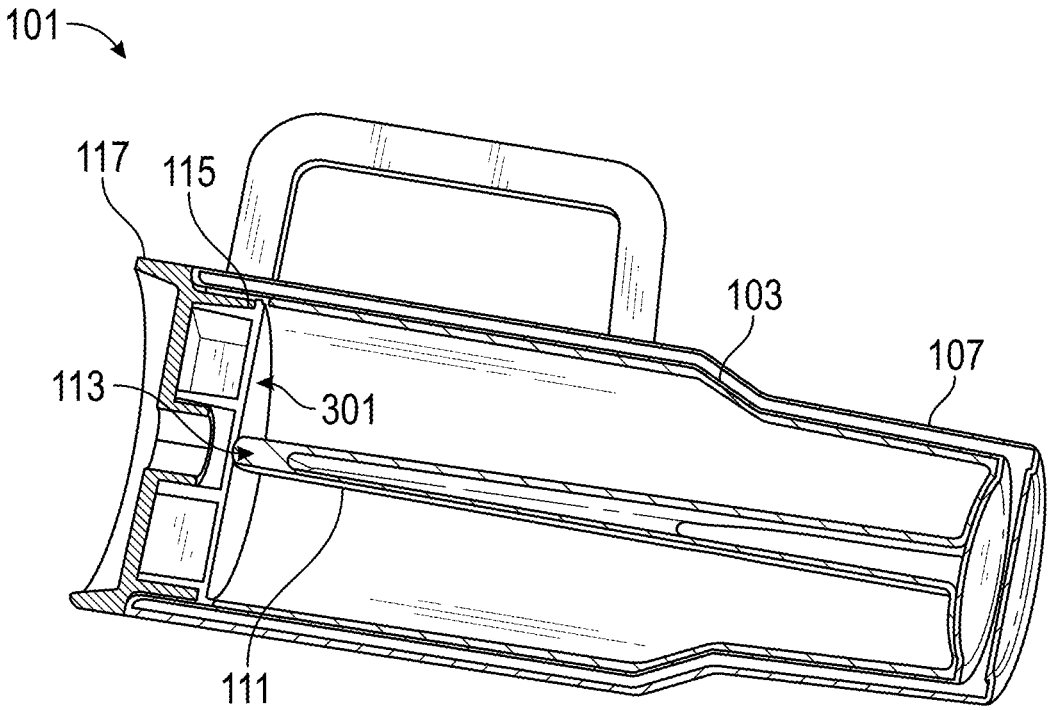
FIG. 3 is a cross-sectional view of the system of FIG. 1.
Figure 12:
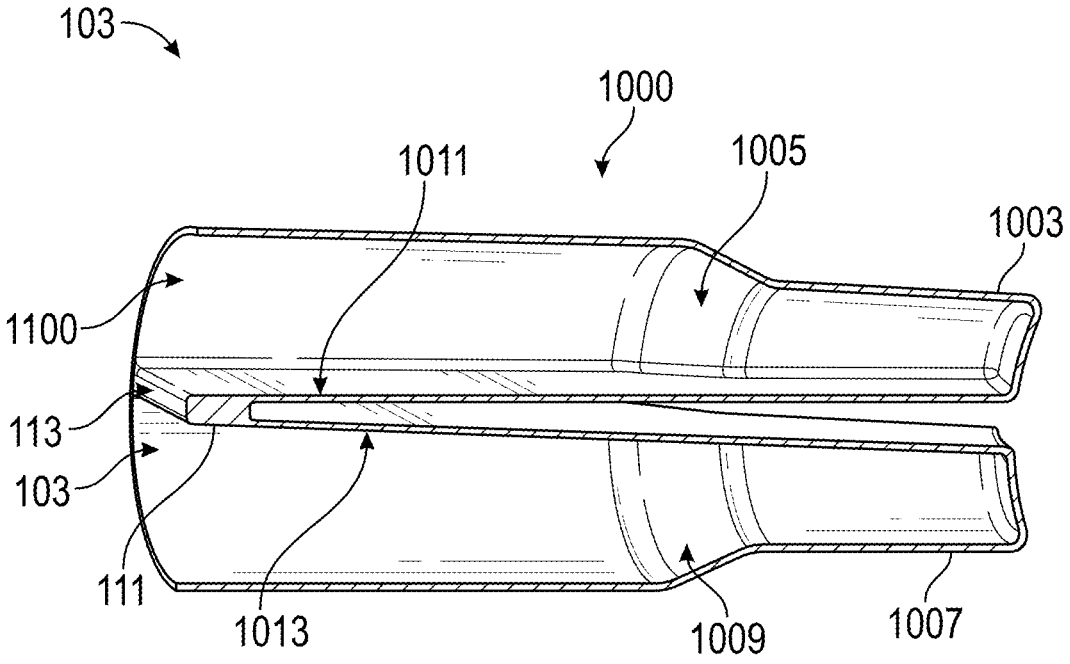
FIG. 12 is a cross-sectional of the housing of FIG. 11.
Figure 13:
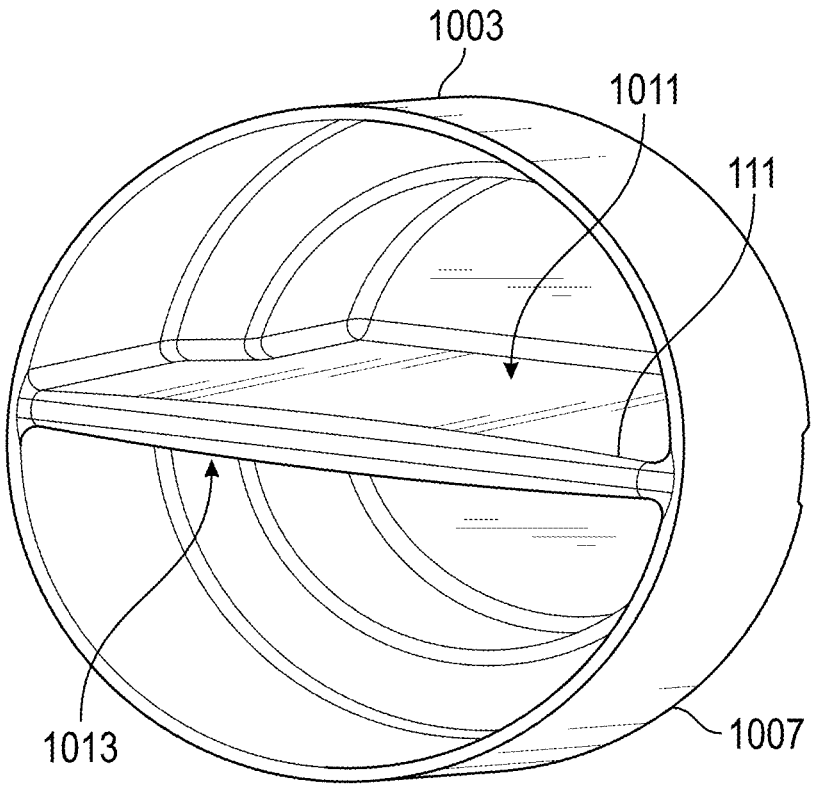
FIG. 13 is a front view of the housing of FIG. 11.

FIGS. 1 and 2 illustrate the system 101 in a disassembled view, while FIG. 3 illustrates the system 101 in an assembled cross-sectional view. Lid stop 115 has a bottom surface 301 that engages with surface 113 of divider 111. The divider 111 separates the inner area of housing 103 into sections 1003 and 1007, which in turn create respective fluid cavities 1005 and 1009 as shown in FIG. 12.

Figure 4:
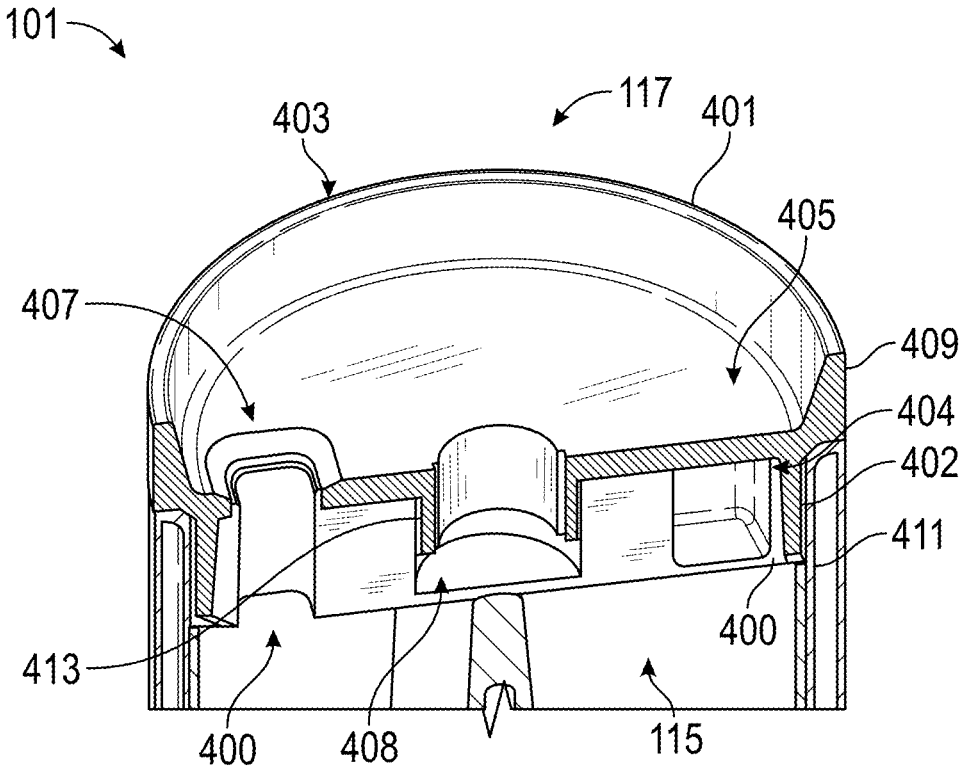
FIG. 4 is a partial cross-sectional view of the system of FIG. 3.

In FIG. 4, a closer view of the components of system 101 are shown in cross-sectional view. The lid 117 has a body 401 that forms a lip 403 and has a bottom surface 405 with a lid opening 407 extending through a thickness and in fluid communication with a lid stop opening 406, that in turn is in fluid communication with either fluid cavity 1005 or 1009. The lid is further provided with a protrusion 413 that is configured to rotate and fit within an indentation 408 created by the body 400 of lid stop 115. This feature allows the lid to rotate relative to the lid stop so that opening 407 opens and closes fluid access to the fluid cavities 1005 and 1009.

Figure 5:
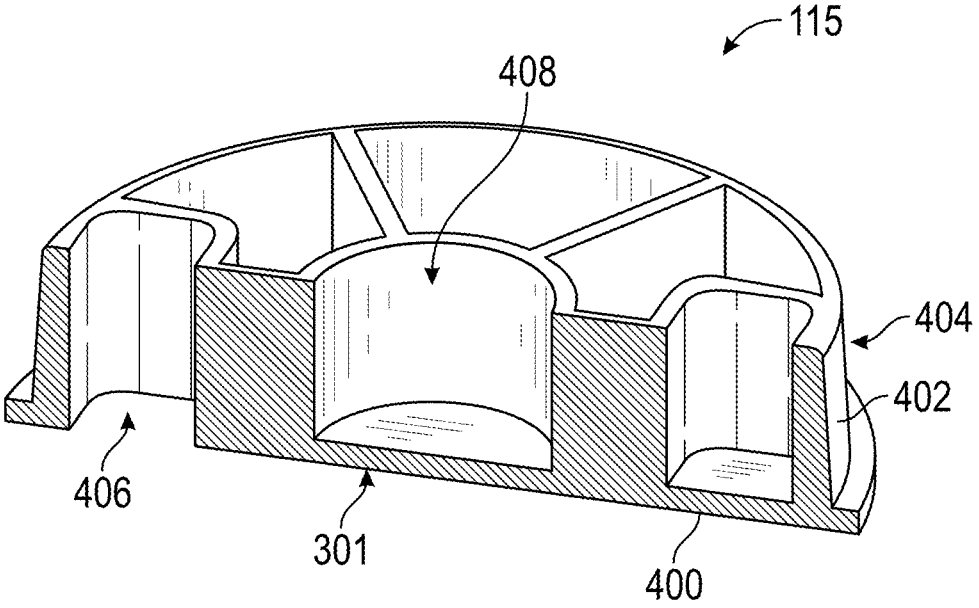
FIG. 5 is a partial view of the system of FIG. 4.

The lid stop 115 includes a side surface 404 of side 402 that engages with a sidewall 411. In the exemplary embodiment, the lid rotates along the side surface 404. As shown, the lip 409 of lid 117 rests on a top surface of cup 107 while the lid stop rests on the housing 103. A cross-sectional view of lid stop 115 is shown in FIG. 5.

Figure 6:
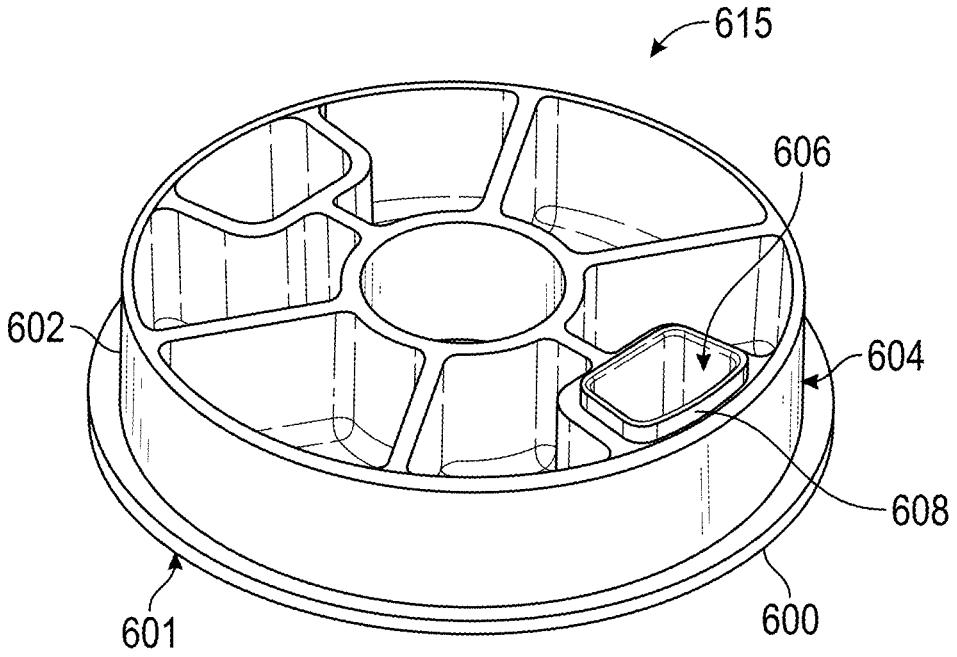
FIG. 6 is an oblique view a lid stop member of an alternative embodiment.
Figure 7:
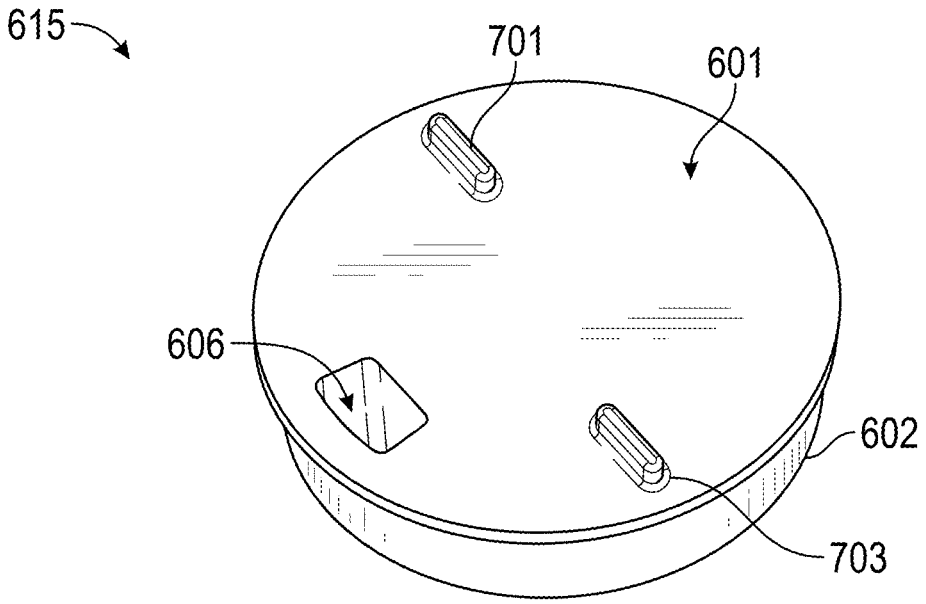
FIG. 7 is a top view of the lid stop member of FIG. 6.

In FIGS. 6 and 7, respective top and bottom views of a lid stop 615 is shown in accordance with an alternative embodiment of the present invention. It should be appreciated that lid stop 615 includes one or more of the features for lid stop 115 with the additional features of having a first stop 701 and a second stop 703 that protrudes from a lower surface 601. The lid stop 615 includes a body 600 having a side surface 604 and that forms a lid stop opening 606 in fluid communication with lid opening 407. The exemplary embodiment has a protrusion 608 extending from opening 606 to engage with lid opening 407.

Figure 8:
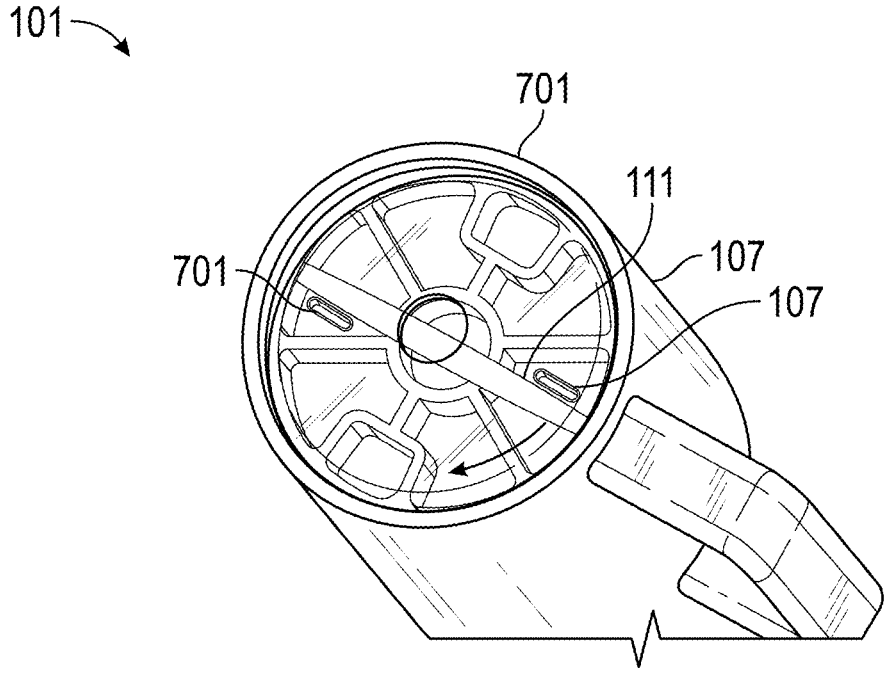
FIG. 8 is an oblique partial view of the system of FIG. 1 with the lid stop of FIG. 6.
Figure 9:
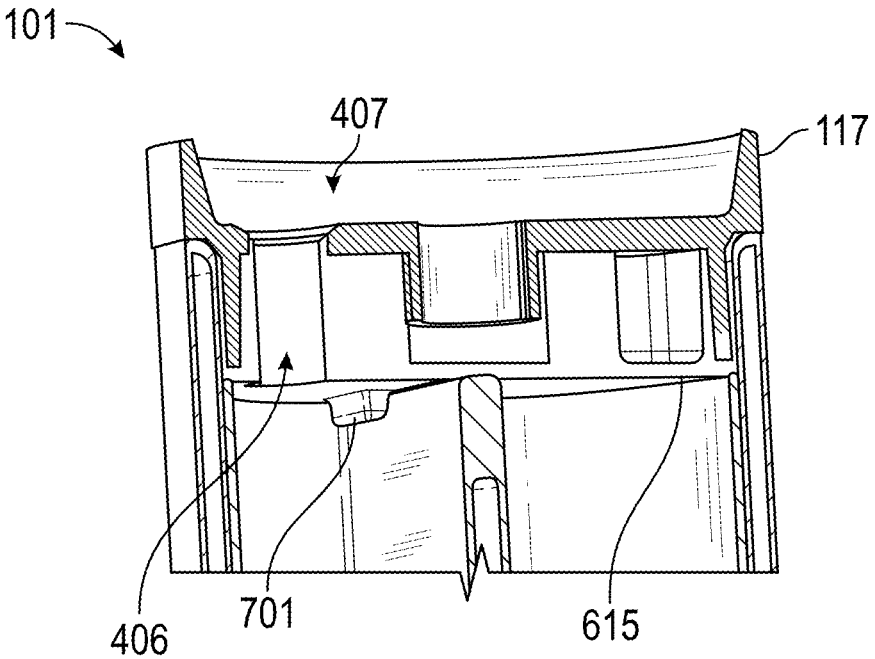
FIG. 9 is a partial cross-sectional view of the system of FIG. 8.
Figure 10:
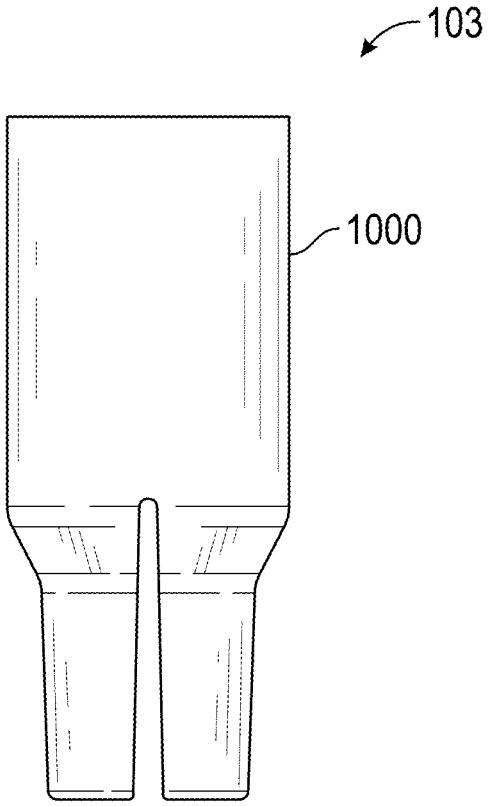
FIG. 10 is a side view of a housing of the system of FIG. 1.
Figure 11:
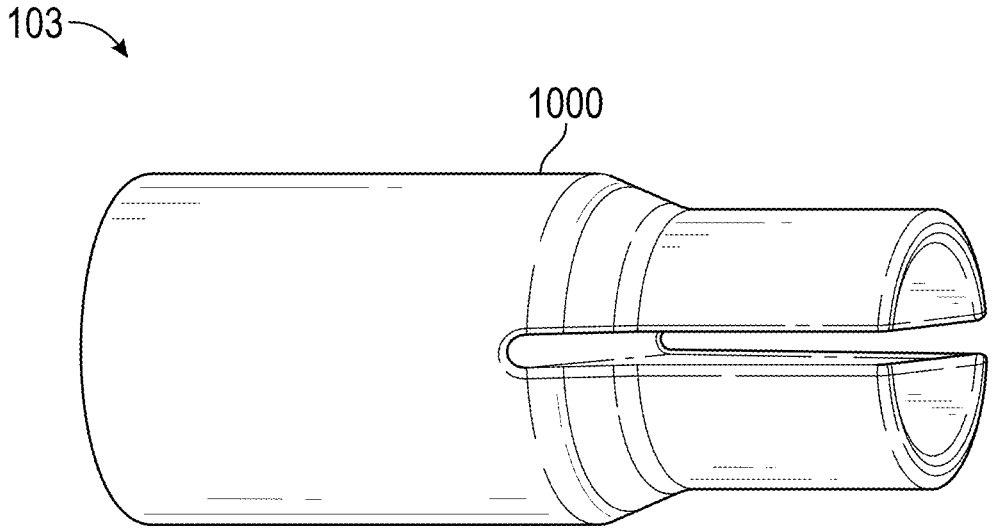
FIG. 11 is a side view of the housing of the system of FIG. 1.

FIGS. 8 and 9 illustrate rotational movement of the lids stop 615 relative to the housing 103. As shown, the stops 701 and 703 are configured to engage with surfaces 1011, 1013 of the divider 111, which in turn stops rotational movement.

FIGS. 10-13 shows various views of the housing 103 having a body 1000 that forms two fluidly separated fluid cavities 1005 and 1009 that are separated via divider 111. During use, the lid and lid stop are rotated such that the openings are in fluid communication with either the fluid cavity 1005 and 1009. Accordingly, a user can fill the fluid cavities with different types of fluid and enjoy a choice of beverage from either cavity.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

What is claimed:

1. A cup system for a cup, comprising:

a cup insert configured to fit within the cup, the cup insert having a housing configured to fit within an inner area of the cup, the housing having:

a first fluid cavity;

a second fluid cavity; and a divider separates the first fluid cavity from the second fluid cavity, the divider having a single upper portion wall within an opening of the cup and a lower portion formed of first surface wall and second surface wall in which a void space is formed between the first surface wall and the second surface wall;

a lid stop rests on the single upper portion wall of the divider, the lid stop having an opening that is in fluid communication with either the first fluid cavity or the second fluid cavity;

a lid with an opening to rotate relative to the lid stop to allow fluid access to either the first fluid cavity or the second fluid cavity.

* * * * *